US011019912B2

(12) United States Patent
Saunders

(10) Patent No.: US 11,019,912 B2
(45) Date of Patent: Jun. 1, 2021

(54) BEACH STORAGE ASSEMBLY

(71) Applicant: Nancy Saunders, Parkton, NC (US)

(72) Inventor: Nancy Saunders, Parkton, NC (US)

( * ) Notice: Subject to any disclaimer, the term of this patent is extended or adjusted under 35 U.S.C. 154(b) by 24 days.

(21) Appl. No.: 16/522,125

(22) Filed: Jul. 25, 2019

(65) Prior Publication Data

US 2021/0022483 A1 Jan. 28, 2021

(51) Int. Cl.
*A45C 3/10* (2006.01)
*A45F 3/44* (2006.01)

(52) U.S. Cl.
CPC . *A45F 3/44* (2013.01); *A45C 3/10* (2013.01)

(58) Field of Classification Search
CPC ..... A45F 3/44; A45F 3/00; A45C 3/10; E04H 12/2215; E04H 12/22; E04H 12/223; E04H 12/2238; E04H 12/2253; E04H 12/2276; E04H 12/2297; E04H 12/32; A63B 71/023; E02D 27/42
USPC ..... 248/125.1, 156
See application file for complete search history.

(56) References Cited

U.S. PATENT DOCUMENTS 1,373,665 A * 4/1921 Lozon ..... A47B 3/00 108/128
1,666,293 A * 4/1928 Lorton ..... A47J 33/00 211/86.01
1,774,909 A * 9/1930 Wells ..... A45B 23/00 135/98
2,195,391 A * 3/1940 Hunter ..... A45B 19/08 248/156
3,076,557 A * 2/1963 Husted ..... A45F 3/44 211/196
3,079,965 A * 3/1963 Troy ..... A45C 3/10 383/25
3,285,554 A * 11/1966 Voelkerding ..... E01F 9/685 248/121
3,318,560 A * 5/1967 Garrette, Jr. ..... E04H 12/182 248/545
3,602,471 A * 8/1971 Reed, III ..... B64D 1/02 248/156
4,065,085 A * 12/1977 Gellatly ..... A47J 33/00 248/124.1
4,447,847 A * 5/1984 Drulard ..... E04H 12/2215 361/117
4,576,350 A * 3/1986 Bond ..... B65B 67/12 248/100
4,625,937 A * 12/1986 Haase ..... F16M 13/00 248/156

(Continued)

*Primary Examiner* — Nkeisha Smith

(57) ABSTRACT

A beach storage assembly includes a pole that is insertable into sand on a beach having the pole being vertically oriented. In this way the pole can extend upwardly out of water of an ocean during incoming high tide. A plurality of legs is each coupled to the pole. Each of the legs is oriented perpendicular to the pole to abut the sand thereby retaining the pole in a vertical orientation. A spike is slidably positioned in the pole. The spike is positionable in a deployed position having the spike extending outwardly from the pole for driving into the sand. A plurality of storage pouches is each releasably coupled to a respective one of the couplers for positioning the storage pouches above waves of the ocean during incoming high tide. Each of the storage pouches can store objects to inhibit the objects from getting wet during incoming high tide.

10 Claims, 7 Drawing Sheets

(56) References Cited

U.S. PATENT DOCUMENTS 4,753,411 A * 6/1988 Lechner ..... E04H 12/2215 248/156
4,910,901 A * 3/1990 Boyar ..... G09F 7/22 40/606.19
5,143,108 A * 9/1992 Kenney ..... A45B 3/00 108/151
5,161,561 A * 11/1992 Jamieson ..... A45B 3/00 108/94
5,273,062 A * 12/1993 Mozdzanowski ..... A45B 3/00 135/16
5,482,246 A * 1/1996 Derkoski ..... E02D 5/801 248/156
5,502,910 A * 4/1996 Lucchesi ..... G09F 7/22 173/91
5,577,611 A 11/1996 Greenall
D382,729 S 8/1997 Piker
5,660,403 A 8/1997 O'Neill
5,887,834 A * 3/1999 Gellos ..... B65F 1/1615 248/156
6,457,683 B1 * 10/2002 Armstrong, Sr. ..... E04H 15/32 248/122.1
6,502,340 B2 * 1/2003 Stone ..... G09F 7/06 248/156
6,547,203 B1 * 4/2003 Willard ..... E02D 5/801 248/530
6,612,320 B2 * 9/2003 Lin ..... A45B 25/22 135/33.41
6,675,819 B2 * 1/2004 Arrowood ..... A45F 3/44 135/118
6,732,985 B1 * 5/2004 Cantrell ..... A45F 3/44 248/125.1
7,077,366 B2 * 7/2006 Young ..... G03B 37/02 248/156
7,175,141 B2 * 2/2007 Bolinder ..... E04H 12/2215 248/156
7,318,266 B2 * 1/2008 Bergh ..... A45F 3/44 248/156
7,475,859 B2 * 1/2009 Selders ..... A45B 3/06 211/107
7,520,485 B1 * 4/2009 Giannetto ..... A01K 97/10 173/91
7,641,156 B2 * 1/2010 Medders ..... A47G 25/12 248/125.8
7,694,487 B1 * 4/2010 Ryan ..... E02D 27/42 52/741.15
7,980,520 B2 * 7/2011 Taylor ..... A45F 3/44 248/156
8,549,799 B2 * 10/2013 Tate ..... A45F 3/44 52/157
9,890,551 B1 * 2/2018 Delao ..... E04H 12/2215
10,244,852 B1 * 4/2019 Donaldson ..... E04H 12/182
10,602,817 B2 * 3/2020 Price ..... A45B 23/00
10,729,226 B1 * 8/2020 Zamora ..... A45F 3/44
2001/0035201 A1 * 11/2001 Kuzmic ..... E04H 12/2215 135/15.1
2003/0173474 A1 * 9/2003 Taylor ..... A45F 3/44 248/156
2007/0051768 A1 * 3/2007 Dobson ..... A63B 47/04 224/666
2009/0289153 A1 * 11/2009 Jarrell ..... A45F 5/1026 248/95
2009/0294622 A1 * 12/2009 Medders ..... A47B 81/04 248/523
2011/0248057 A1 * 10/2011 Schmitz ..... A45C 3/04 224/275
2013/0038770 A1 * 2/2013 Hawkins ..... H04N 5/222 348/333.01
2014/0305348 A1 * 10/2014 Vasquez ..... A47B 13/023 108/23
2015/0108295 A1 * 4/2015 Brooks ..... F16M 11/242 248/156

* cited by examiner

BEACH STORAGE ASSEMBLY

CROSS-REFERENCE TO RELATED APPLICATIONS

Statement Regarding Federally Sponsored Research or Development

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to storage devices and more particularly pertains to a new storage device for storing objects above water during incoming high tide.

BRIEF SUMMARY OF THE INVENTION

An embodiment of the disclosure meets the needs presented above by generally comprising a pole that is insertable into sand on a beach having the pole being vertically oriented. In this way the pole can extend upwardly out of water on the shore of an ocean during incoming high tide. A plurality of legs is each coupled to the pole. Each of the legs is oriented perpendicular to the pole to abut the sand thereby retaining the pole in a vertical orientation. A spike is slidably positioned in the pole. The spike is positionable in a deployed position having the spike extending outwardly from the pole for driving into the sand. A plurality of storage pouches is each releasably coupled to a respective one of the couplers for positioning the storage pouches above the waves of the ocean during incoming high tide. Each of the storage pouches can store objects to inhibit the objects from getting wet during incoming high tide.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
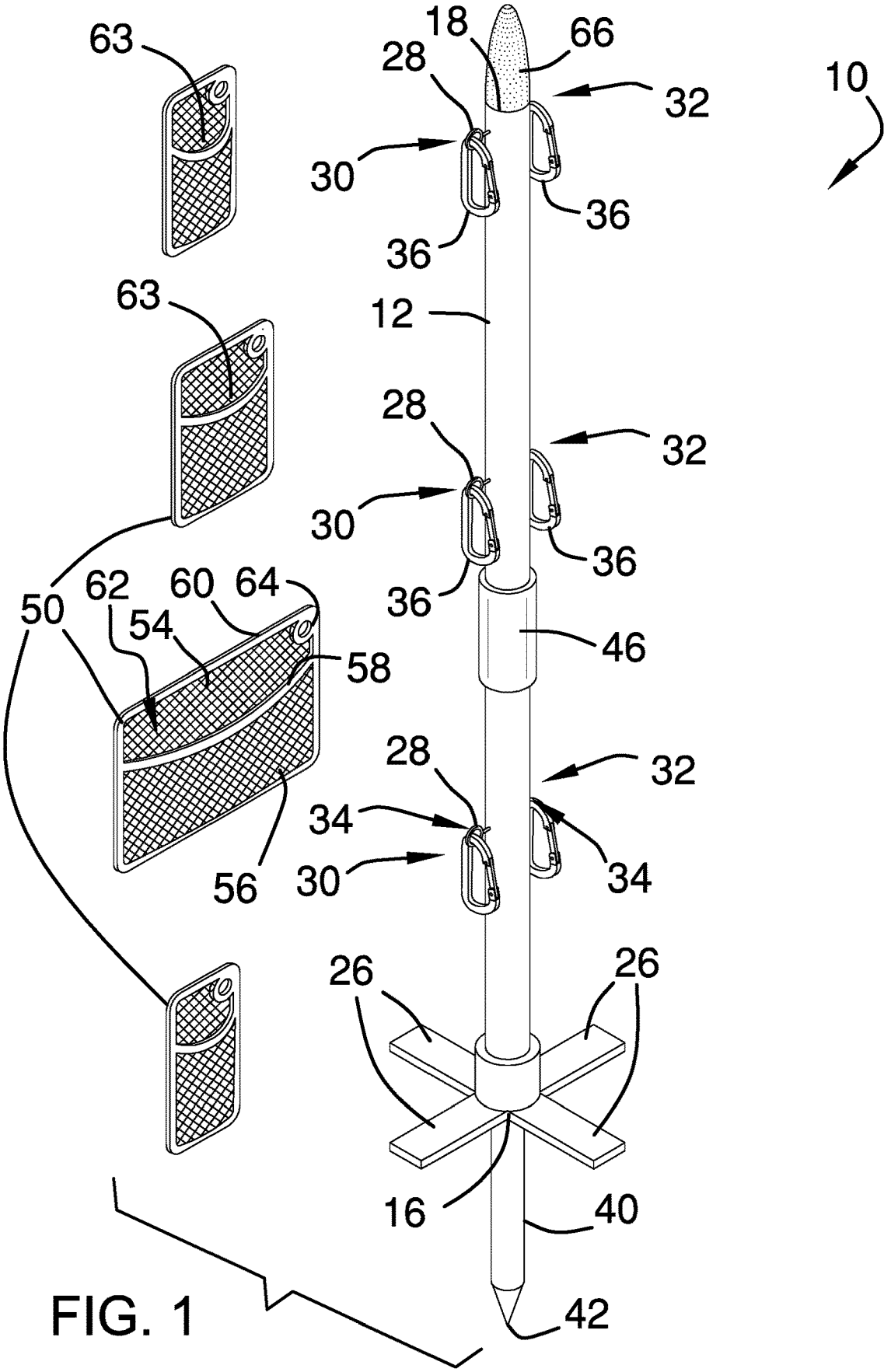
FIG. 1 is a perspective view of a beach storage assembly according to an embodiment of the disclosure.
Figure 2:
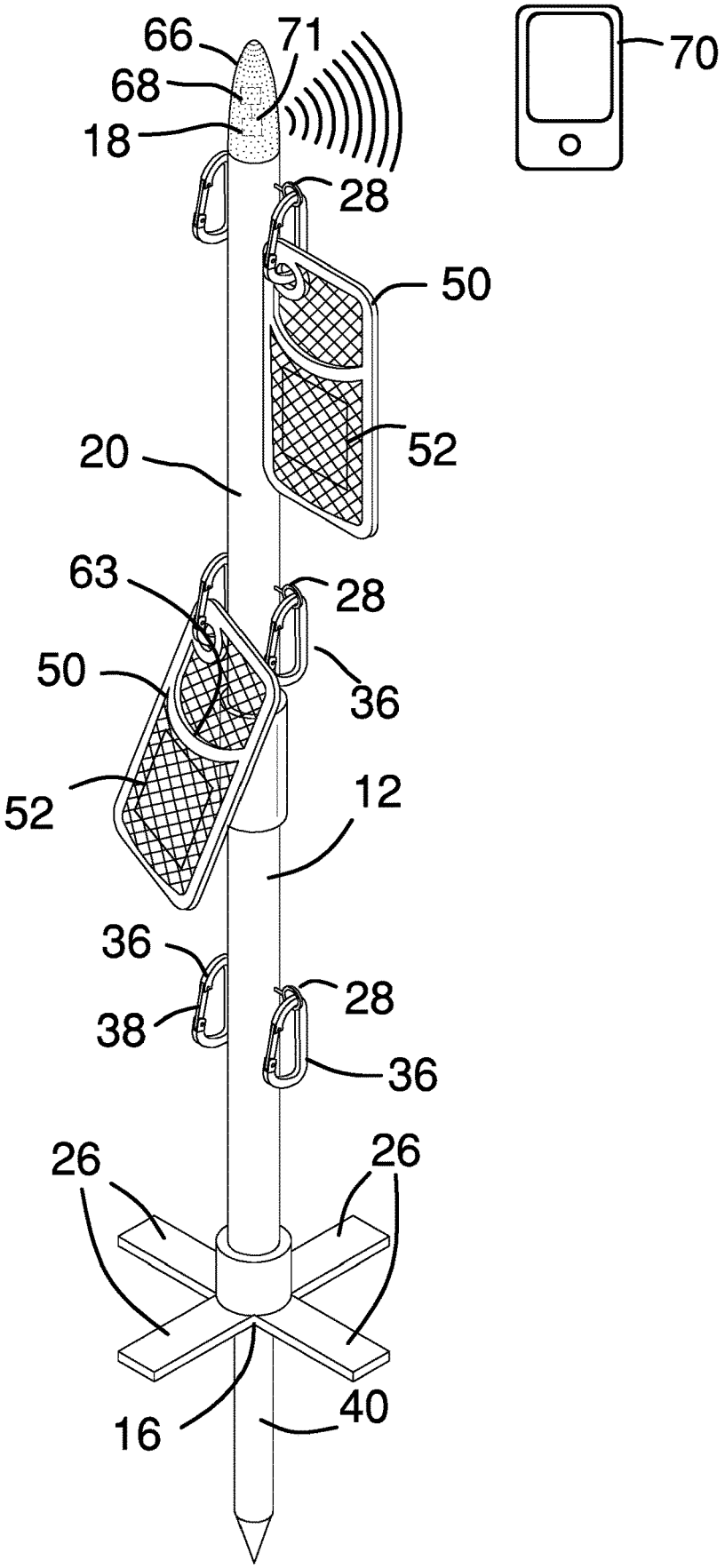
FIG. 2 is a front perspective view of an embodiment of the disclosure.

With reference now to the drawings, and in particular to FIGS. 1 through 7 thereof, a new storage device embodying the principles and concepts of an embodiment of the disclosure and generally designated by the reference numeral 10 will be described.

As best illustrated in FIGS. 1 through 7, the beach storage assembly 10 generally comprises a pole 12 that is insertable into sand 14 on a beach having the pole 12 being vertically oriented. In this way the pole 12 extends upwardly out of water of an ocean during incoming high tide. The pole 12 has a first end 16, a second end 18 and an outer wall 20 extending therebetween. The first end 16 is open and the pole 12 is hollow. The outer wall 20 has a first aperture 22 extending into an interior of the pole 12 and the first aperture 22 is spaced from the first end 16 of the pole 12. Additionally, the outer wall 20 has a second aperture 24 extending into the interior of the pole 12 and the second aperture 24 is spaced upwardly from the first aperture 22. The pole 12 may have a length ranging between approximately 1.0 m and 1.5 m.

A plurality of legs 26 is each coupled to the pole 12 and each of the legs 26 is oriented perpendicular to the pole 12. Each of legs 26 abuts the sand 14 thereby retaining the pole 12 in a vertical orientation. Each of the legs 26 is positioned on the outer wall 20 of the pole 12 and each of the legs 26 is aligned with the first end 16 of the pole 12. Additionally, the legs 26 are spaced apart from each other and are distributed around the pole 12.

A plurality of fasteners 28 is each coupled to the pole 12 having each of the fasteners 28 being oriented perpendicular to the pole 12. Each of the fasteners 28 threadably engages the outer wall 20 of the pole 12. The fasteners 28 are spaced apart from each other and are distributed from the second end 18 of the pole 12 toward the first end 16 of the pole 12. The plurality of fasteners 28 includes a first set 30 and a second set 32 of fasteners that is each positioned on opposite sides of the pole 12 from each other. Moreover, a bottom most pair 34 of the fasteners 28 is spaced at least 12.0 inches from the first end 16 of the pole 12. Each of the fasteners 28 may comprise an eyebolt or other threaded fastener.

A plurality of couplers 36 is each removably coupled to a respective one of the fasteners 28 having each of the couplers 36 being suspended from the respective fastener. Each of the couplers 36 includes a gate 38 that is pivotally coupled thereto. The gate 38 on each of the couplers 36 is biased into a closed position and the gate 38 on each of the couplers 36 is urgeable into an open position. Each of the couplers 36 may comprise a carabiner or other type of openable coupler.

A spike 40 is slidably positioned in the pole 12. The spike 40 is positionable in a deployed position having the spike 40 extending outwardly from the pole 12 for driving into the sand 14. The spike 40 is positionable in a retracted position having the spike 40 being concealed in the pole 12. The spike 40 has a bottom end 42 and an upper end 44, and the bottom end 42 tapers to a point for piercing the sand 14. A grip 46 is positioned around the pole 12 for gripping and the grip 46 is centrally positioned between the first 16 and second 18 ends of the pole 12. The grip 46 enhances gripping the pole 12 for driving the spike 40 into the sand 14.

A lock 48 is movably coupled to the spike 40 and the lock 48 is biased to extend outwardly from the spike 40. The lock 48 is spaced downwardly from the upper end 44 of the spike 40. The lock 48 releasably engages the first aperture 22 in the pole 12 when the spike 40 is positioned in the deployed position. Additionally, the lock 48 releasably engages the second aperture 24 in the pole 12 when the spike 40 is in the retracted position.

A plurality of storage pouches 50 is each releasably coupled to a respective one of the couplers 36. In this way each of the storage pouches 50 is positioned above the waves of the ocean during incoming high tide. Each of the storage pouches 50 has objects 52 positioned therein for storage to inhibit the objects 52 from getting wet during incoming high tide. Each of the storage pouches 50 has a front wall 54 and a back wall 56. The front wall 54 has a top edge 58 that is spaced downwardly from a top edge 60 of the back wall 56 to define an opening 62 into the pouches 50. Additionally, the back wall 56 has a hole 64 extending therethrough for receiving the respective coupler 36 and the hole 64 is aligned with the top edge 60 of the back wall 56.

Each of the storage pouches 50 may be comprised of fluid impermeable material for protecting contents of the storage pouches 50 from moisture. Each of the storage pouches 50 includes a closure 63 that is aligned with the top edge 58 of the front wall 54. The closure 63 engages the back wall 56 for opening and closing the opening 52. The closure 63 on each of the storage pouches 50 forms a fluid impermeable seal to inhibit sand from entering the storage pouches 50. Additionally, the closure 63 on each of the storage pouches 50 may comprise a zipper, a multiple use adhesive, a hook and loop fastener or any other type of closure than can form a fluid impermeable seal.

A speaker 66 is coupled to the pole 12 for emitting audible sound outwardly therefrom and the speaker 66 is positioned on the second end 18 of the pole 12. A transceiver 68 is coupled to the pole 12 and the transceiver 68 is electrically coupled to the speaker 66. The transceiver 68 is in wireless electrical communication with a remote audio source 70, such as a smart phone or the like, for receiving an audio signal from the remote audio source 70. The transceiver 68 may be a radio frequency transceiver or the like and the transceiver 68 may employ Bluetooth communication protocols. A power supply 71 is positioned in the pole 12, the power supply 71 is electrically coupled to the transceiver 68 and the power supply 71 comprises at least one battery.

Figure 3:
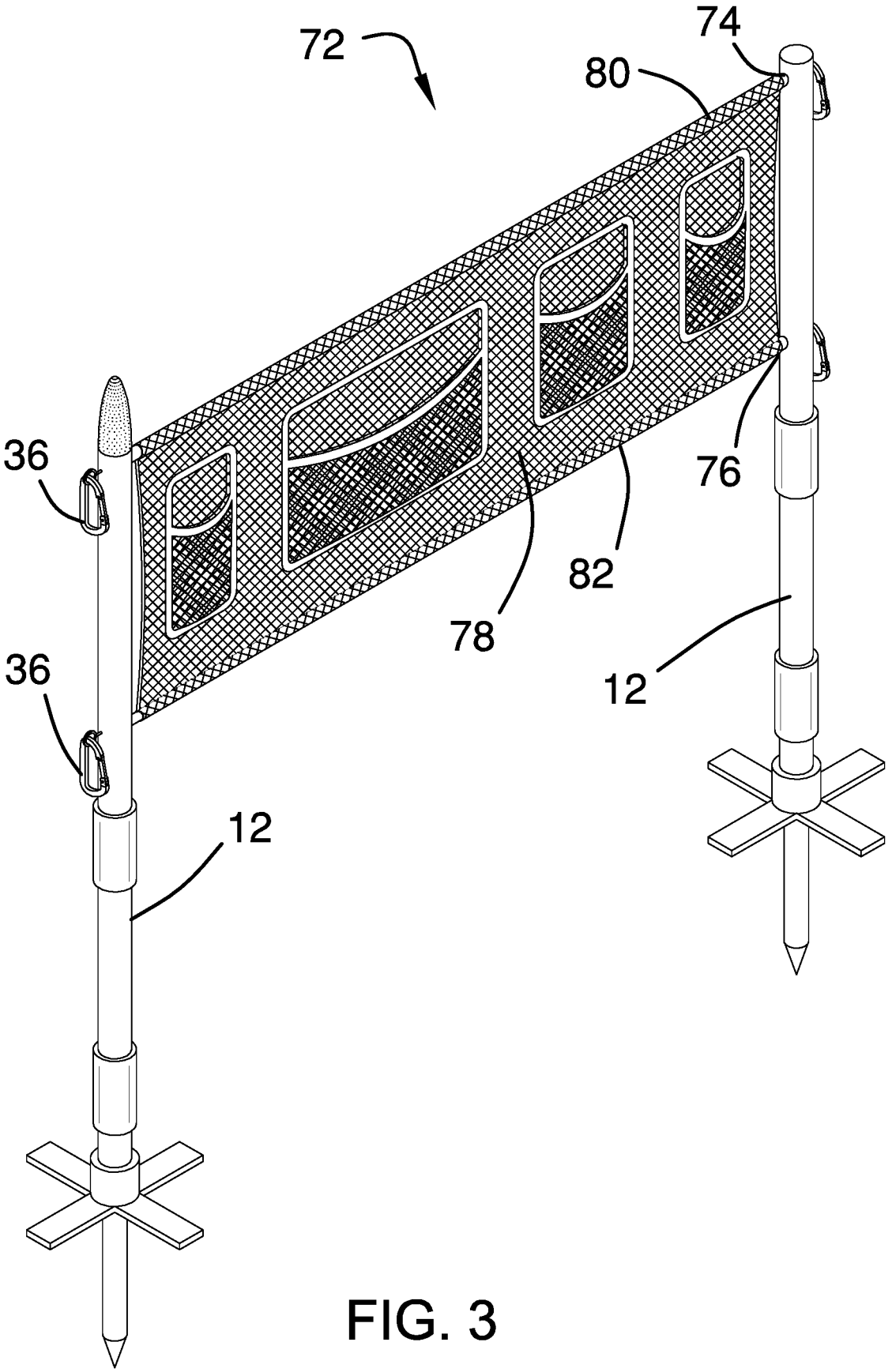
FIG. 3 is a perspective view of an alternative embodiment of the disclosure.
Figure 4:
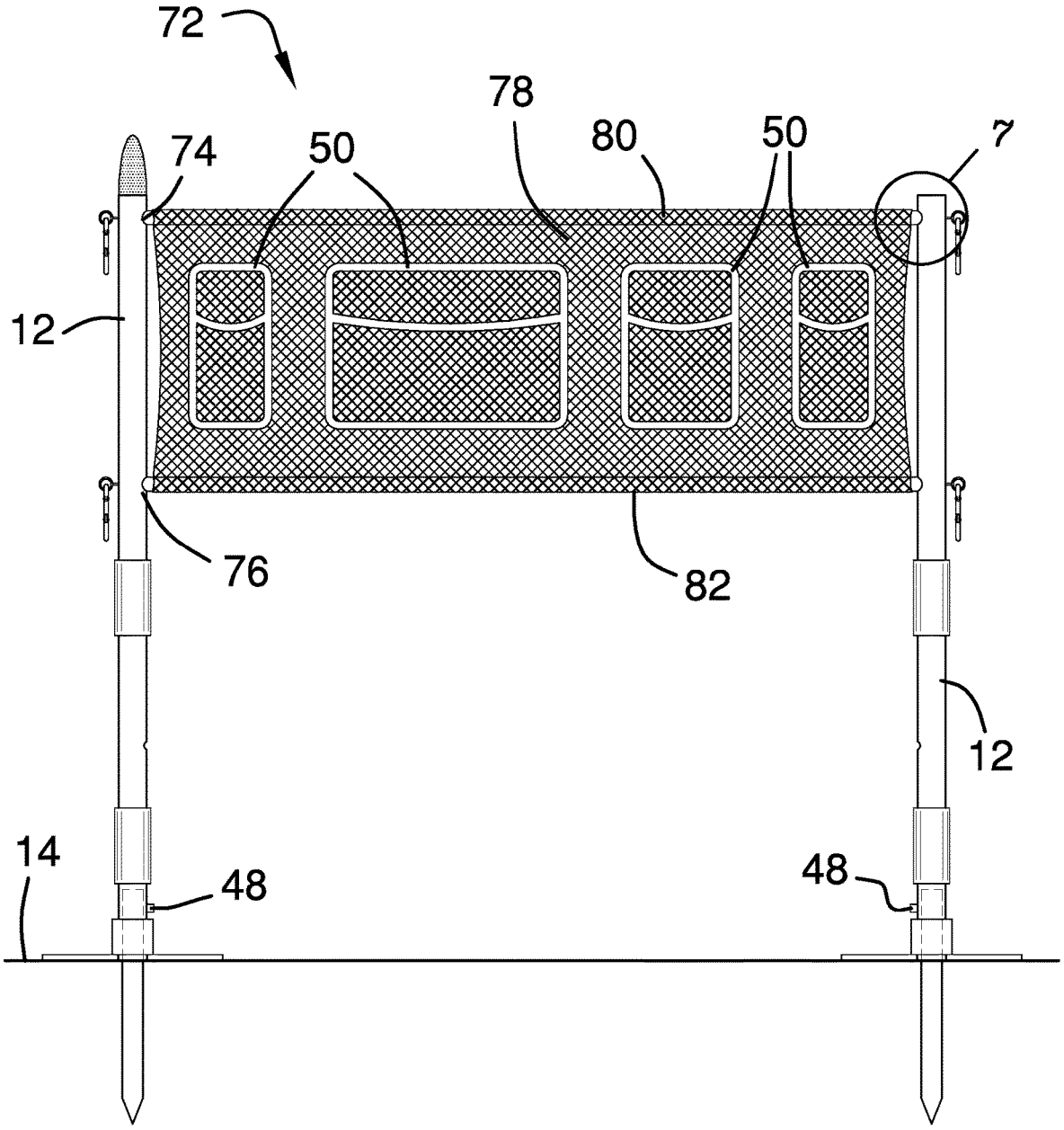
FIG. 4 is a front view of an alternative embodiment of the disclosure.
Figure 5:
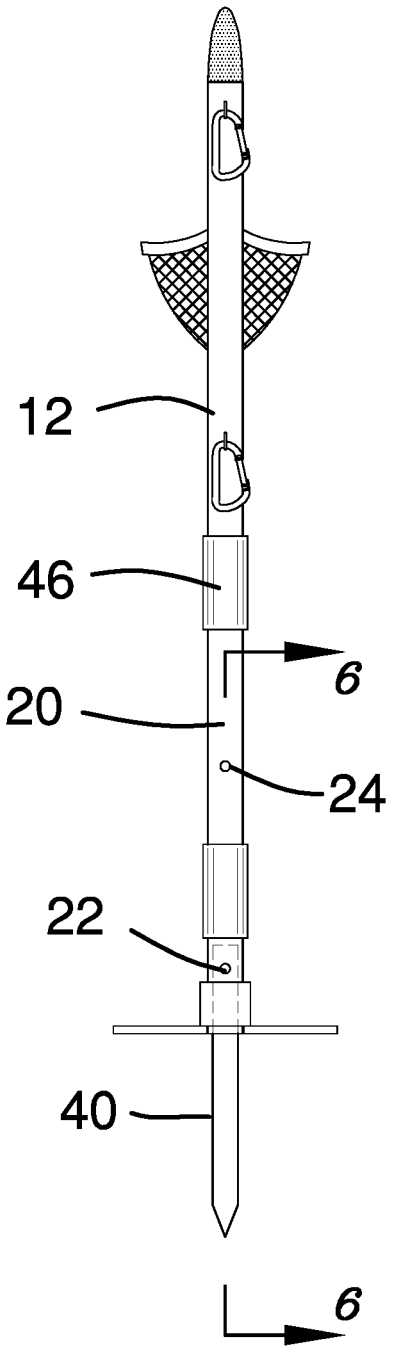
FIG. 5 is a right side view of an embodiment of the disclosure.
Figure 6:
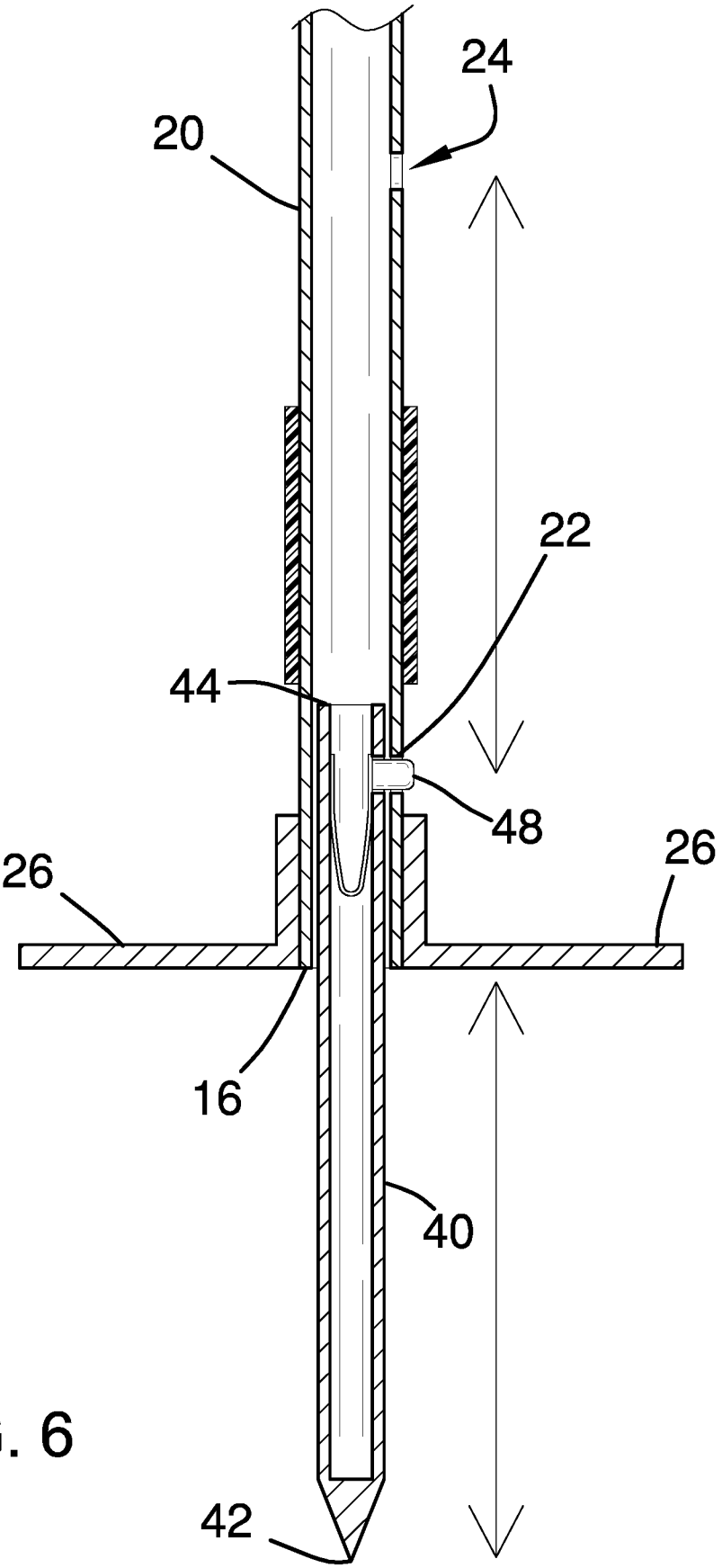
FIG. 6 is a cross sectional view taken along line 6-6 of FIG. 5 of an embodiment of the disclosure.
Figure 7:
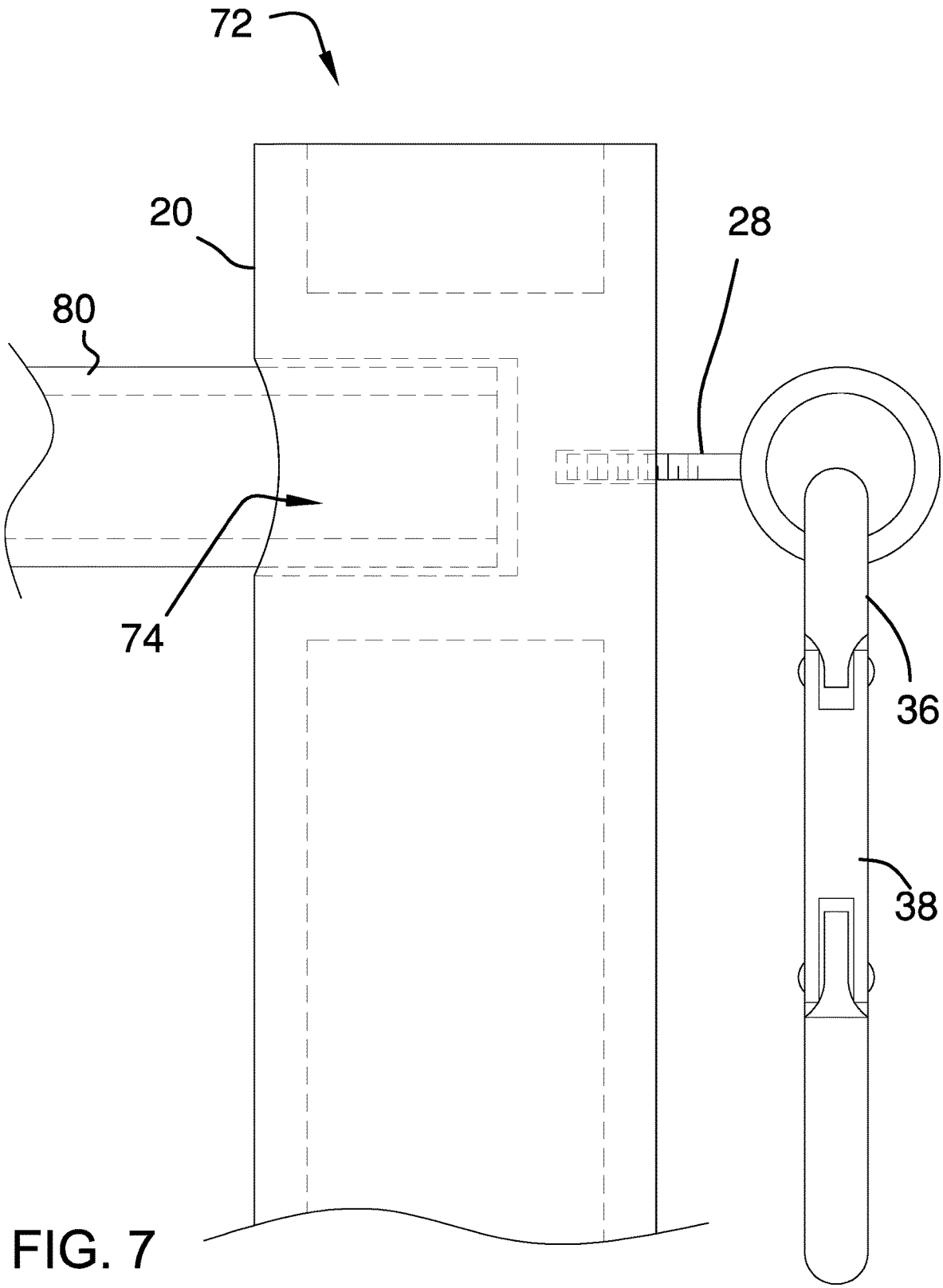
FIG. 7 is a phantom view taken from circle 7 of FIG. 4 of an embodiment of the disclosure.

In an alternative embodiment 72 as shown in FIGS. 3, 4 and 7, a pair of the poles 12 is provided. The outer wall 20 of each of the poles 12 has a first well 74 extending inwardly therein and the first well 74 on each of the poles 12 is spaced from the second end 18 of the poles 12. Each of the poles 12 has a second well 76 extending inwardly therein and the second well 76 is spaced downwardly from the first well 74. Each of the poles 12 is spaced apart from each other on the beach having the first 74 and second 76 wells in each of the poles 12 being directed toward each other. Continuing in the alternative embodiment 72, a net 78 is provided that has a first rod 80 being coupled to a top edge of the net 78 and a second rod 82 being coupled to a bottom edge of the net 78. Each of the first 80 and second 82 rods is insertable into respective ones of the first 74 and second 76 wells for stretching the net 78 between the poles 12. Additionally, each of the storage pouches 50 is coupled to the net 78 and the storage pouches 50 are spaced apart from each other and are distributed along the net 78.

In use, the pole 12 is taken to the beach and the spike 40 is positioned in the deployed position. The spike 40 is urged into the sand 14 on the beach until the legs 26 abut the sand 14. Each of the storage pouches 50 can have an object positioned therein for storage. Thus, the object in each of the storage pouches 50 is spaced upwardly from the water during incoming high tide. In this way the objects 52 are inhibited from getting wet if a user inadvertently forgets about incoming high tide. Thus, the user can enjoy the beach without worrying that the objects 52 will get wet or be washed out to sea. Additionally, the transceiver 68 can be synched with a smart phone or the like in the convention of Bluetooth audio for streaming audio from the speaker 66.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A beach storage assembly being configured to store objects above sand on a beach thereby protecting the objects from incoming tide, said assembly comprising:

a pole being insertable into sand on a beach having said pole being vertically oriented wherein said pole is configured to extend upwardly out of waves of an ocean during incoming high tide, said pole having a first end, a second end and an outer wall extending therebetween;

a plurality of legs, each of said legs being coupled to said pole, each of said legs being oriented perpendicular to said pole wherein said plurality of legs is configured to abut the sand thereby retaining said pole in a vertical orientation;

a plurality of fasteners, each of said fasteners being coupled to said pole having each of said fasteners being oriented perpendicular to said pole;

a plurality of couplers, each of said couplers being removably coupled to a respective one of said fasteners having each of said couplers being suspended from said respective fastener;

a spike being slidably positioned in said pole, said spike being positionable in a deployed position having said spike extending outwardly from said pole wherein said spike is configured to be driven into the sand, said spike being positionable in a retracted position having said spike being concealed in said pole;

a plurality of storage pouches, each of said storage pouches being releasably coupled to a respective one of said couplers wherein each of said storage pouches is configured to be positioned above the water of the ocean during incoming high tide, each of said storage pouches having objects being positioned therein wherein each of said storage pouches is configured to inhibit the objects from getting wet during incoming high tide;

a speaker being coupled to said pole wherein said speaker is configured to emit audible sound outwardly therefrom, said speaker being positioned on said second end of said pole; and wherein each of said storage pouches has a front wall and a back wall, said front wall having a top edge being spaced downwardly from a top edge of said back wall to define an opening into said pouches, said back wall having an opening extending therethrough for receiving said respective coupler, said opening being aligned with said top edge of said back wall.

2. The assembly according to claim 1, wherein:

said first end being open, said pole being hollow;

said outer wall has a first aperture extending into an interior of said pole, said first aperture being spaced from said first end of said pole; and said outer wall has a second aperture extending into said interior of said pole, said second aperture being spaced upwardly from said first aperture.

3. The assembly according to claim 2, wherein each of said legs is positioned on said outer wall of said pole, each of said legs being aligned with said first end of said pole, said legs being spaced apart from each other and being distributed around said pole.

4. The assembly according to claim 2, wherein:

each of said fasteners threadably engages said outer wall of said pole, said fasteners being spaced apart from each other and being distributed from said second end of said pole toward said first end of said pole;

said plurality of fasteners includes a first set and a second set of fasteners each being positioned on opposite sides of said pole from each other; and a bottom most pair of said fasteners being spaced at least 12.0 inches from said first end of said pole.

5. The assembly according to claim 2, wherein:

said spike has a bottom end and an upper end, said bottom end tapering to a point for piercing the sand; and said assembly includes a lock being movably coupled to said spike, said lock being biased to extend outwardly from said spike, said lock being spaced downwardly from said upper end of said spike, said lock releasably engaging said first aperture in said pole when said spike is positioned in said deployed position, said lock releasably engaging said second aperture in said pole when said spike is in said retracted position.

6. The assembly according to claim 1, wherein each of said storage pouches includes a closure being aligned with said top edge said front wall, said closure engaging said back wall for opening and closing said opening, said closure on each of said pouches forming a fluid impermeable seal wherein said closure on each of said pouches is configured to inhibit sand from entering said storage pouches.

7. The assembly according to claim 1, further comprising:

a transceiver being coupled to said pole, said transceiver being electrically coupled to said speaker, said transceiver being in wireless electrical communication with a remote audio source for receiving an audio signal from the remote audio source; and a power supply being positioned in said pole, said power supply being electrically coupled to said transceiver, said power supply comprising at least one battery.

8. A beach storage assembly being configured to store objects above sand on a beach thereby protecting the objects from incoming tide, said assembly comprising:

a pole being insertable into sand on a beach having said pole being vertically oriented wherein said pole is configured to extend upwardly out of water of an ocean during incoming high tide, said pole having a first end, a second end and an outer wall extending therebetween, said first end being open, said pole being hollow, said outer wall having a first aperture extending into an interior of said pole, said first aperture being spaced from said first end of said pole, said outer wall having a second aperture extending into said interior of said pole, said second aperture being spaced upwardly from said first aperture;

a plurality of legs, each of said legs being coupled to said pole, each of said legs being oriented perpendicular to said pole wherein said plurality of legs is configured to abut the sand thereby retaining said pole in a vertical orientation, each of said legs being positioned on said outer wall of said pole, each of said legs being aligned with said first end of said pole, said legs being spaced apart from each other and being distributed around said pole;

a plurality of fasteners, each of said fasteners being coupled to said pole having each of said fasteners being oriented perpendicular to said pole, each of said fasteners threadably engaging said outer wall of said pole, said fasteners being spaced apart from each other and being distributed from said second end of said pole toward said first end of said pole, said plurality of fasteners including a first set and a second set of fasteners each being positioned on opposite sides of said pole from each other, a bottom most pair of said fasteners being spaced at least 12.0 inches from said first end of said pole;

a plurality of couplers, each of said couplers being removably coupled to a respective one of said fasteners having each of said couplers being suspended from said respective fastener, each of said couplers having a gate being pivotally coupled thereto, said gate on each of said couplers being biased into a closed position, said gate on each of said couplers being urgeable into an open position;

a spike being slidably positioned in said pole, said spike being positionable in a deployed position having said spike extending outwardly from said pole wherein said spike is configured to be driven into the sand, said spike being positionable in a retracted position having said spike being concealed in said pole, said spike having a bottom end and an upper end, said bottom end tapering to a point for piercing the sand;

a lock being movably coupled to said spike, said lock being biased to extend outwardly from said spike, said lock being spaced downwardly from said upper end of said spike, said lock releasably engaging said first aperture in said pole when said spike is positioned in said deployed position, said lock releasably engaging said second aperture in said pole when said spike is in said retracted position;

a plurality of storage pouches, each of said storage pouches being releasably coupled to a respective one of said couplers wherein each of said storage pouches is configured to be positioned above waves of the ocean during incoming high tide, each of said storage pouches having objects being positioned therein wherein each of said storage pouches is configured to inhibit the objects from getting wet during incoming high tide, each of said storage pouches having a front wall and a back wall, said front wall having a top edge being spaced downwardly from a top edge of said back wall to define an opening into said pouches, said back wall having an opening extending therethrough for receiving said respective coupler, said opening being aligned with said top edge of said back wall, each of said storage pouches includes a closure being aligned with said top edge of said front wall, said closure on each of said pouches engaging said back wall for opening and closing said opening, said closure on each of said pouches forming a fluid impermeable seal wherein said closure on each of said pouches is configured to inhibit sand from entering said storage pouches;

a speaker being coupled to said pole wherein said speaker is configured to emit audible sound outwardly therefrom, said speaker being positioned on said second end of said pole;

a transceiver being coupled to said pole, said transceiver being electrically coupled to said speaker, said transceiver being in wireless electrical communication with a remote audio source for receiving an audio signal from the remote audio source; and a power supply being positioned in said pole, said power supply being electrically coupled to said transceiver, said power supply comprising at least one battery.

9. A beach storage assembly being configured to store objects above sand on a beach thereby protecting the objects from incoming tide, said assembly comprising:

a pole being insertable into sand on a beach having said pole being vertically oriented wherein said pole is configured to extend upwardly out of waves of an ocean during incoming high tide, said pole having a first end, a second end and an outer wall extending therebetween;

a plurality of legs, each of said legs being coupled to said pole, each of said legs being oriented perpendicular to said pole wherein said plurality of legs is configured to abut the sand thereby retaining said pole in a vertical orientation;

a plurality of fasteners, each of said fasteners being coupled to said pole having each of said fasteners being oriented perpendicular to said pole;

a plurality of couplers, each of said couplers being removably coupled to a respective one of said fasteners having each of said couplers being suspended from said respective fastener;

a spike being slidably positioned in said pole, said spike being positionable in a deployed position having said spike extending outwardly from said pole wherein said spike is configured to be driven into the sand, said spike being positionable in a retracted position having said spike being concealed in said pole;

a plurality of storage pouches, each of said storage pouches being releasably coupled to a respective one of said couplers wherein each of said storage pouches is configured to be positioned above the water of the ocean during incoming high tide, each of said storage pouches having objects being positioned therein wherein each of said storage pouches is configured to inhibit the objects from getting wet during incoming high tide;

a speaker being coupled to said pole wherein said speaker is configured to emit audible sound outwardly therefrom, said speaker being positioned on said second end of said pole;

a transceiver being coupled to said pole, said transceiver being electrically coupled to said speaker, said transceiver being in wireless electrical communication with a remote audio source for receiving an audio signal from the remote audio source;

a power supply being positioned in said pole, said power supply being electrically coupled to said transceiver, said power supply comprising at least one battery; and wherein a pair of said poles is provided, said outer wall of each of said poles having a first well extending inwardly therein, said first well on each of said poles being spaced from said second end of said poles, each of said poles having a second well extending inwardly therein, said second well being spaced downwardly from said first well, each of said poles being spaced apart from each other on the beach having said first and second wells in each of said poles being directed toward each other.

10. The assembly according to claim 9, further comprising a net having a first rod being coupled to a top edge of said net and a second rod being coupled to a bottom edge of said net, each of said first and second rods being insertable into respective ones of said first and second wells for stretching said net between said poles, each of said storage pouches being coupled to said net, said storage pouches being spaced apart from each other and being distributed along said net.

* * * * *